US005123479A

United States Patent [19]

Pravda

[11] Patent Number: 5,123,479

[45] Date of Patent: Jun. 23, 1992

[54] ROTARY HEAT EXCHANGER OF IMPROVED EFFECTIVENESS

[75] Inventor: Milton F. Pravda, Towson, Md.

[73] Assignee: Conserve Resources, Inc., Prescott, Wash.

[21] Appl. No.: 728,348

[22] Filed: Jul. 11, 1991

[51] Int. Cl.[5] ..... F28D 15/02

[52] U.S. Cl. ..... 165/86; 165/104.25

[58] Field of Search ..... 165/104.25, 86

[56] References Cited

U.S. PATENT DOCUMENTS 2,813,698 11/1957 Lincoln ..... 165/104.25
4,640,344 2/1987 Pravda ..... 165/86

FOREIGN PATENT DOCUMENTS 58-19691 2/1983 Japan .
1083065 3/1984 U.S.S.R. ..... 165/86

OTHER PUBLICATIONS

Niekawa, J. et al., *Performance . . . Heat Pipes . . . A Rotary Heat Exchanger,* Heat Recovery Systems, vol. 1, pp. 331-338, 1981.

*Primary Examiner*—Albert W. Davis, Jr.
*Attorney, Agent, or Firm*—Eugene D. Farley

[57] ABSTRACT

A Perkins tube type rotary heat exchanger of improved efficiency wherein the Perkins tube evaporation sections are outwardly displaced from the condensation sections by offsetting and/or splaying, to substantially occupy the evaporation sections with Perkins tube working fluid while substantially eliminating the presence of fluid from a major portion of the condensation sections during operation of the heat exchanger. This has the effect of maximizing the internal evaporative area within the evaporation sections and also of maximizing the internal condensing area within the condensation sections of the Perkins tubes, thereby materially increasing the energy recovery and effectiveness of the heat exchanger.

19 Claims, 5 Drawing Sheets

ROTARY HEAT EXCHANGER OF IMPROVED EFFECTIVENESS

This invention relates to rotary heat exchangers of general class designed to operate in high gravity fields, as described in U.S. Pat. No. 4,640,344 issued to Milton F. Pravda on Feb. 3, 1987.

BACKGROUND AND GENERAL STATEMENT OF THE INVENTION

Rotary heat exchangers of the class under consideration are of widespread and important application. They are useful, for example in recovering thermal energy from the contaminated exhaust effluents of laundry dryers, grain dryers, asphalt aggregate mixers, and the various processing units to be found in the textile, food and fiberboard manufacturing industries. They rely for heat exchange function upon the inclusion in their structures of a plurality of Perkins tubes.

It is the general purpose of the present invention to provide a novel heat exchanger of the described class which is of simple, relatively inexpensive construction but of greatly improved effectiveness. As a consequence, its use in the various applications to which it is suited has the potential of resulting in significant savings of heat energy, and hence of operating costs.

Briefly stated, the presently described rotary heat exchanger includes in its assembly a rotor traversing an evaporation chamber and a condensation chamber. A plurality of Perkins tubes having evaporation sections and condensation sections is mounted on the rotor. The evaporation sections of the Perkins tubes extend into the evaporation chamber and the condensation sections extend into the condensation chamber.

It has not been found possible to improve the effectiveness of rotary heat exchangers by employing capillary means to redistribute the working fluid circumferentially in the evaporation section. This is because the high force fields created by rotation strongly suppress capillarity, thereby rendering this mechanism ineffective.

To circumvent the disadvantage posed by the lack of capillarity, the present invention is predicated on the discovery that by the simple expedient of providing Perkins tubes of the above construction wherein the tube evaporation sections are displaced radially outwardly from the condensation sections with reference to the axis of rotation of the rotor, and using in the Perkins tubes a working fluid in amount sufficient to optimally occupy the evaporation sections with fluid while substantially eliminating the presence of fluid from the condenser sections, the efficiency of the evaporation cycle of the former and the condensation cycle of the latter is increased to a significant extent. This results in important energy and, consequently, economic savings during operation of the heat exchanger.

Without commitment to a particular heat transfer theory, it is known that this result stems from improving the efficiency with which the working fluid contained in the Perkins tubes is vaporized in the evaporation sections of the tubes and condensed in the condensation sections thereof. The entire inner surface area of the evaporation section of each Perkins tube is heated by the exhaust gas, and this entire inner surface is capable of heating and vaporizing the working fluid. This optimum heat transfer condition can only obtain if the working fluid is in direct contact with the entire inner surface. However, because space must be provided for vapor flow, the working fluid cannot completely occupy and thereby completely contact the entire inner surface of the evaporation section. It is readily apparent that an optimum heat transfer and vapor flow area condition exists wherein the disposition of the working fluid is such as to maximize the inner surface area in contact with the working fluid and, simultaneously, provide the required vapor flow space.

The entire inner surface area of the condensation section of each Perkins tube is cooled by the supply gas, and this entire inner surface is capable of cooling and condensing the working fluid vapor. The optimum heat transfer condition can only obtain if the working fluid vapor is in direct contact with the entire inner surface. This condition obtains when the condensation section of each Perkins tube is substantially free of working fluid. The overall result is a significantly improved efficiency of the heat exchanger.

THE DRAWINGS

Figure 4A:
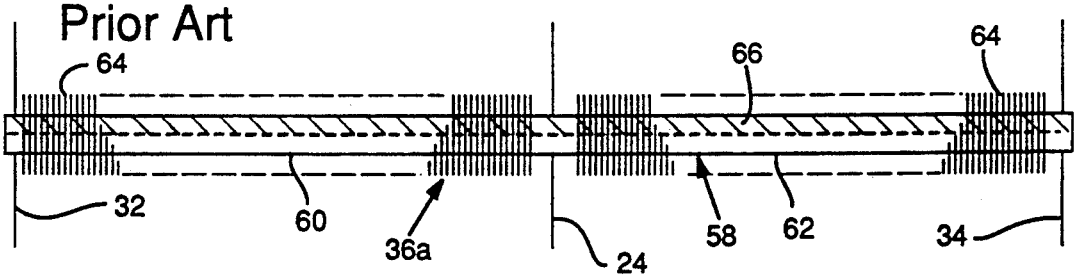
FIG. 4A Prior Art
Figure 4B:
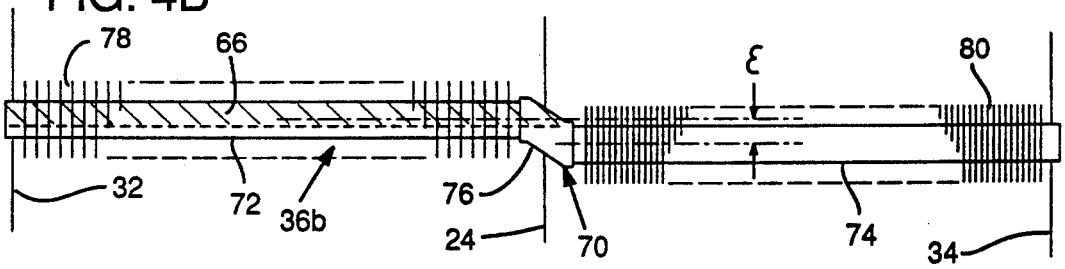
Figure 4C:
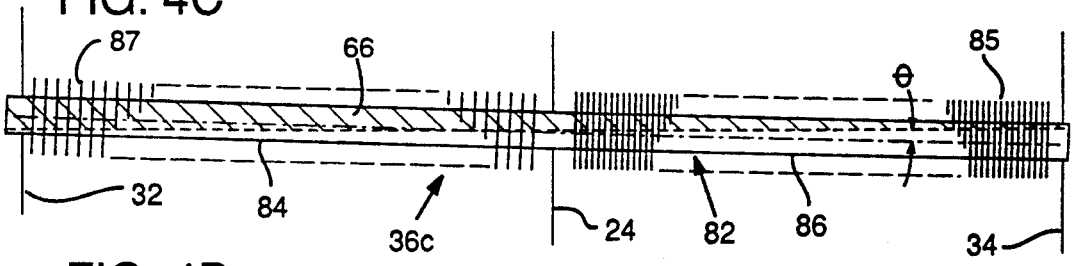
Figure 4D:
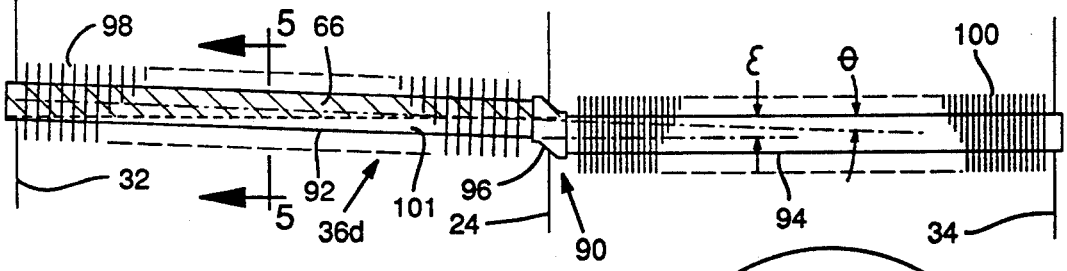

FIG. 4A is a schematic side elevation view of the Perkins tube of the prior art as disclosed in U.S. Pat. No. 4,640,344. FIGS. 4B–D inclusive are schematic side elevational views of the Perkins tube components of the herein described heat exchanger illustrating structural alternatives for achieving a displaced position of the evaporation sections of the tubes relative to the condensation sections thereof.

Figure 5:
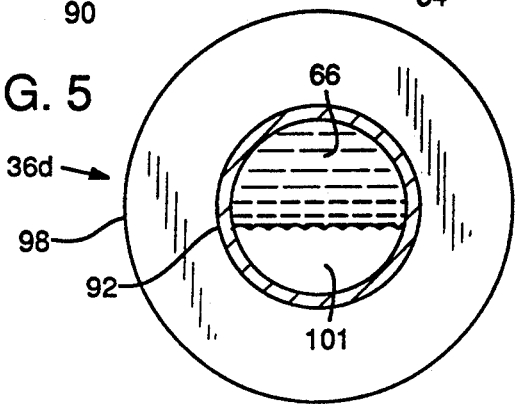

FIG. 5 is a transverse sectional view taken along line 5—5 of FIG. 4D; and FIGS. 6 A–D inclusive are enlarged, schematic views in side elevation, similar to FIGS. 4 A–D, inclusive illustrating prior art and also illustrating the displaced relation of the Perkins tube evaporation sections relative to the condensation sections thereof, which characterizes the heat exchangers of my invention.

DESCRIPTION OF PREFERRED EMBODIMENTS OF THE INVENTION

Figure 1:
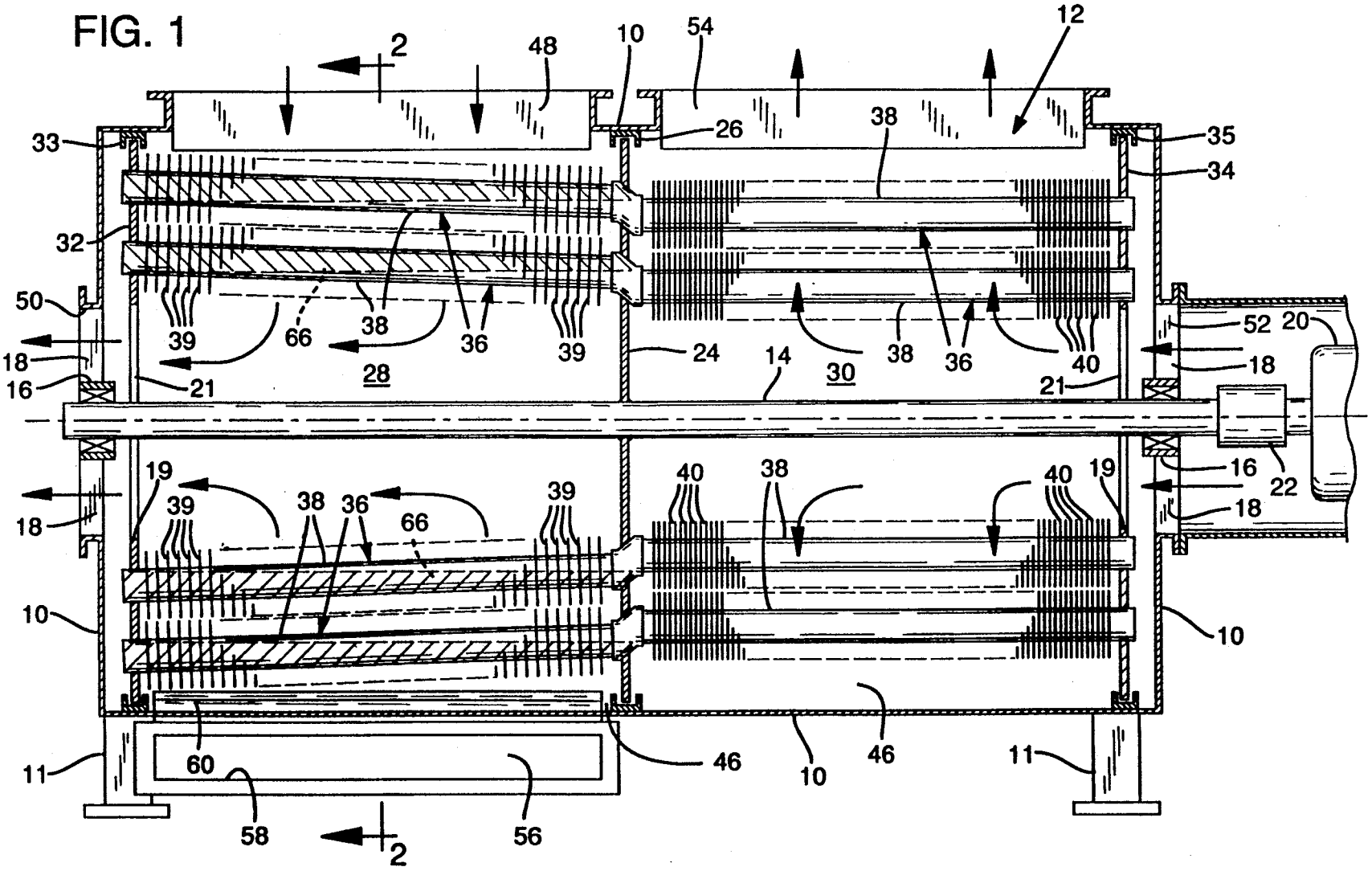
FIG. 1 is a longitudinal section of the rotary heat exchanger of my invention in one of its embodiments.
Figure 2:
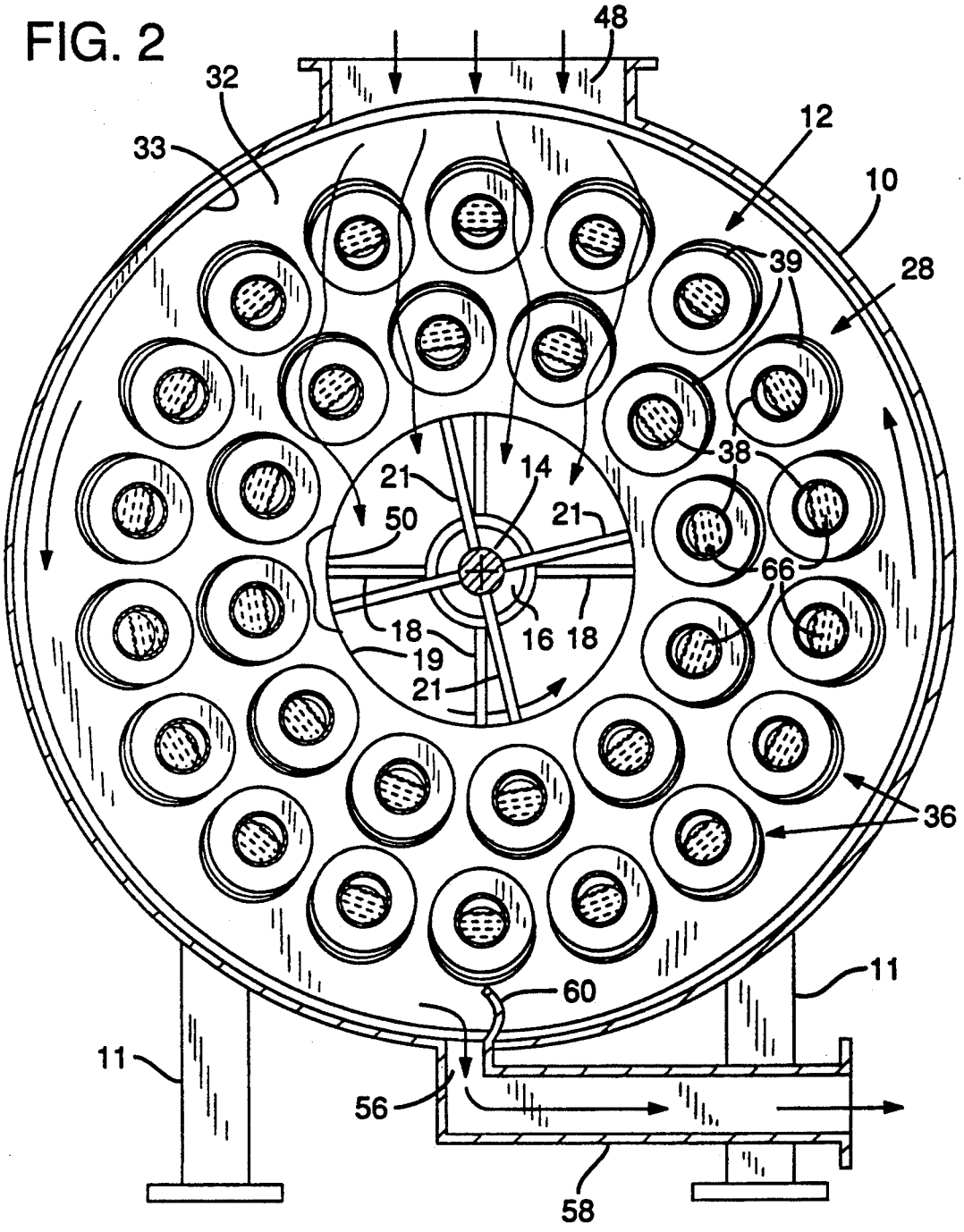
FIG. 2 is a transverse section taken along the lines 2—2 of FIG. 1.

FIGS. 1 and 2 illustrate the general construction and arrangement of my improved rotary heat exchanger, in one of its embodiments.

As shown, the exchanger includes an outer case 10 which is elongated and preferably substantially cylindrical.

The case ends are partly closed, with axially located openings.

A rotor indicated generally at 12 is housed within the case.

A central shaft 14, which extends longitudinally the entire length of the case, centrally thereof, mounts the rotor. The shaft, in turn, is mounted rotatably in bearings 16. These are supported by struts 18, fixed to case 10.

A variable speed motor 20 drives the rotor. The motor is coupled to the rotor by means of a flexible coupling 22.

Shaft 14 mounts a centrally disposed, radially extending partition plate or barrier plate 24. The plate is rigidly mounted on shaft 14, as by welding. Its diameter is but slightly less than the internal diameter of case 10. Its margin is received in a central seal 26.

The interior of case 10 thus is divided into two chambers by partition plate 24. A first chamber 28 is termed herein an "evaporation chamber" or "exhaust gas chamber" because in it the working fluid within the Perkins tubes 36 is evaporated by heat exchange with hot contaminated air or other gas exhausted from a laundry dryer or other associated appliance.

A second chamber 30 is termed herein a "condensation chamber" or "supply gas chamber", since in it the vapor produced within the Perkins tubes 36 in chamber 28 is condensed within the Perkins tubes 36 by heat exchange with cool supply gas, such as cool outside air.

A pair of end plates having hollow centers 19 interrupted only by spiders 21 rigidly connected to central shaft 14 also are included in the rotor assembly.

End plate 32 with associated seal 33, together with partition plate 24 and associated seal 26, define evaporation chamber 28. End plate 34 with associated seal 35 together with partition plate 24 and associated seal 26, define condensation chamber 30.

Mounted on plates 24, 32 and 34 is an array of Perkins tubes, indicated generally and generically in FIGS. 1 and 2 at 36, and specifically in FIGS. 3–6 in four embodiments 36*a*, 36*b*, 36*c*, and 36*d*. The Perkins tubes are to be described in detail hereinafter. They comprise hollow tubes or pipes hermetically sealed at both ends, having plain or grooved interior surfaces, and mounting a plurality of parallel, closely spaced, radially extending heat-absorbing or heat-dissipating fins.

As usual, the Perkins tubes are partly filled with a suitable heat exchange liquid 66 termed herein a "Perkins tube working fluid" or "working fluid" or plain "fluid". These fluids comprise liquids well known for this purpose such as water, methanol, liquid ammonia, liquid metals, and the Freons e.g. the liquid fluorocarbons such as the difluorodichloromethanes, etc.

The plurality of Perkins tubes may be arranged in an annular array comprising two concentric rows, with the components of one row being in offset or staggered relation to the components of the other row as illustrated in FIG. 2. However, other arrangements are feasible. In large diameter heat exchangers more than two annular rows may be used.

As is more fully explained hereinbelow, Perkins tubes 36 include evaporation sections and condensation sections. The evaporation sections of the tubes by definition are those sections which extend into evaporation chamber 28. The condensation sections are those sections which extend into condensation chamber 30.

In the operation of the device, the working fluid is vaporized in the evaporation section of the Perkins tubes located in the evaporation chamber 28 and passes as a vapor into the condensation section of the Perkins tubes located in the relatively cool condensation chamber 30, where it is condensed. The condensed vapor (liquid) in the condensation section then is driven by the centrifugal force generated by the rotation of the rotor back into the evaporation section where the cycle again is initiated.

The case 10, which is stationary, is provided with five openings or ports with associated duct work.

The first port is an inlet port 48, preferably arranged radially of the rotor for introducing hot, contaminated gas from the associated appliance into evaporation chamber 28.

The second is an outlet port 50 arranged axially of the rotor for venting cooled exhaust gas from the exhaust gas chamber 28.

A second inlet port 52 is arranged axially of the rotor for introducing cool fresh air or other gas into condensation chamber 30.

A second outlet port 54 is arranged radially of the supply gas chamber 30 for venting the heated outside air from the chamber.

The fifth port is a purge port 56, FIGS. 1 and 2, which, communicates with a purging duct 57 with associated airfoil 59 which may or may not be included in the presently described assembly. It purges from the evaporation chamber 28 a portion of its content of the cooled exhaust gases with entrained particulates and/or condensed contaminant vapors.

All of the foregoing elements of the assembly are characteristic of the heat exchanger set forth in my U.S. Pat. No. 4,640,344 aforesaid.

The novel elements of the present assembly comprise the Perkins tubes 36 which are used in conjunction with rotor 12 and, as is developed hereinafter, take advantage of the centrifugal force of from about 30 to about 300 gravities generated thereby. These are designed in three illustrative embodiments having evaporation and condensation sections, mounted in the respective evaporation and condensation chambers 28, 30 with the evaporation sections extending into the evaporation chamber and the condensation sections extending into the condensation chamber, but with the evaporation sections being radially outwardly displaced from the condensation sections.

High centrifugal forces attend successful operation in contaminated equipment and process effluents. Although such forces suppress capillarity and thereby preclude conventional solutions to improving heat exchanger effectiveness, these forces are advantageous in several other respects. They permit precise placement of the working fluid within the Perkins tube, it being their nature that the portions of the Perkins tube displaced furthermost radially are first to be occupied by working fluid. Consequently, by controlling the radial disposition of various portions of the Perkins tube and also the quantity of working fluid charged into the Perkins tube, the working fluid placement is easily controlled.

Additionally, it is known that the heat transport capacity of Perkins tubes charged with a given quantity of working fluid increases in direct proportion to the speed of rotation or directly as the square root of the centrifugal force. In view of this, the space required for vapor flow is much less than that normally considered acceptable. Finally, as centrifugal force increases, the internal heat transfer coefficient within the evaporation section of the Perkins tube and the internal condensing heat transfer coefficient within the condensation section both increase, thereby increasing the heat transfer efficiency of the unit.

To take advantage of these considerations, the Perkins tubes of the unit are charged with working fluid 66 to an extent predetermined during normal operation of the heat exchanger to occupy a major portion of the evaporation sections with fluid and to substantially eliminate the presence of fluid from a major portion of the condensation sections, thereby increasing substantially the efficiency of the evaporation cycle in the former and of the condensation cycle in the latter.

Thus the evaporation sections are charged with the working fluid to from about 50% to about 100% of their capacity and with fluid-derived vapor to from about 50% to about 100% of their capacity. The condensation sections, on the other hand, are charged with working fluid to from about 0% to about 22% of their capacities, the balance being charged with fluid-derived vapor.

As shown in FIGS. 4B–4D and 6B–6D, such a displacement may be obtained by offsetting and/or by splaying the evaporation sections of the tubes relative to the condensation sections.

Figure 6A:
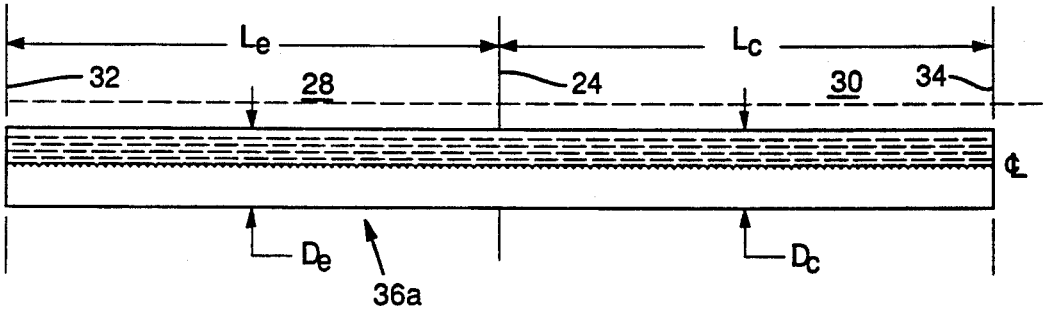

FIGS. 4A and 6A are included for purposes of comparison. They illustrate a prior art finned Perkins tube 36*a*, FIG. 4A, such as is used in the heat exchanger of U.S. Pat. No. 4,640,344. It is of the class in which the entire tube is mounted with its longitudinal axis parallel to the axis of rotation of the rotor 14, and wherein the longitudinal axis of the condensation section of the tube is coaxial with the longitudinal axis of the evaporation section thereof.

The tube assembly thus includes an elongated, hermetically sealed tube 58. The tube is divided at central partition 24 into an evaporation section 60 and a communicating condensation section 62. The evaporation section has a length $L_e$ and a diameter $D_e$. The condensation section has a length $L_c$ and a diameter $D_c$, all as illustrated in FIG. 6A and equally applicable to FIGS. 6B, 6C, and 6D.

External fins 64 assist the tube in performing its heat exchange functions.

The tube normally is charged to an extent of about 50% of its capacity with a Perkins tube working fluid 66. As explained above, such a fluid may comprise water, liquid ammonia, methanol, the Freons or the like.

The Perkins tube assembly 36*b* of FIG. 4B is of the class wherein the evaporation section of the tube when assembled in the heat exchanger is radially outwardly displaced from the condensation section by being offset therefrom.

In the present discussion, the term "offset" is defined as a radial displacement "epsilon" of the axial center line of the evaporation section of the Perkins tube with respect to the axial center line of the condensation section. In the offset condition, the axial center lines of the evaporation and condensation sections remain parallel to the axis of heat exchanger rotation.

Figure 6B:
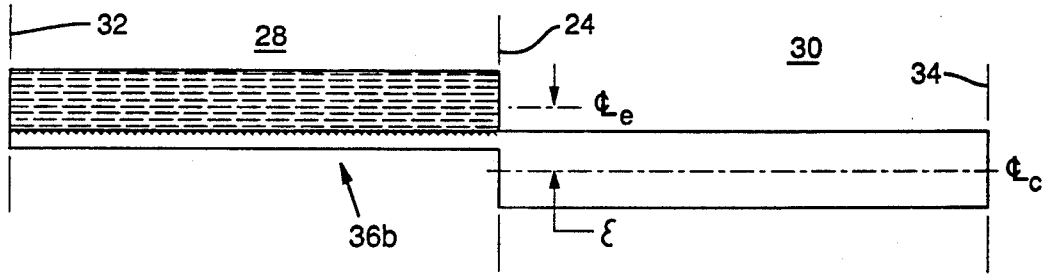

Thus the Perkins tube assembly of FIGS. 4B and 6B comprises a segmented Perkins tube indicated at 70. It includes an evaporation section 72 and a condensation section 74. These are coupled by an hollowed-angled connector 76 in such a manner that evaporation section 72 is offset radially from the condensation section 74. The axial center lines of both sections, however, remain parallel to the axis of rotation of the heat exchanger.

The evaporation section 72 of the tube mounts radial fins 78; the condensation section, radial fins 80. Fins 78 are more widely spaced than are fins 80 as is appropriate for operation in contaminated gas, since the evaporation chamber of the heat exchanger is the dirty side.

The tube contains a quantity of working fluid 66. This is used in amount such that during the operation of the heat exchanger the evaporation section of the tube is substantially occupied with fluid while the condensation section is substantially empty. However, the passageway between the two sections at hollowed-angled connector 76 is kept open to permit the required flows of fluid and vapor between the condensation and evaporation sections and conversely.

Figure 3:
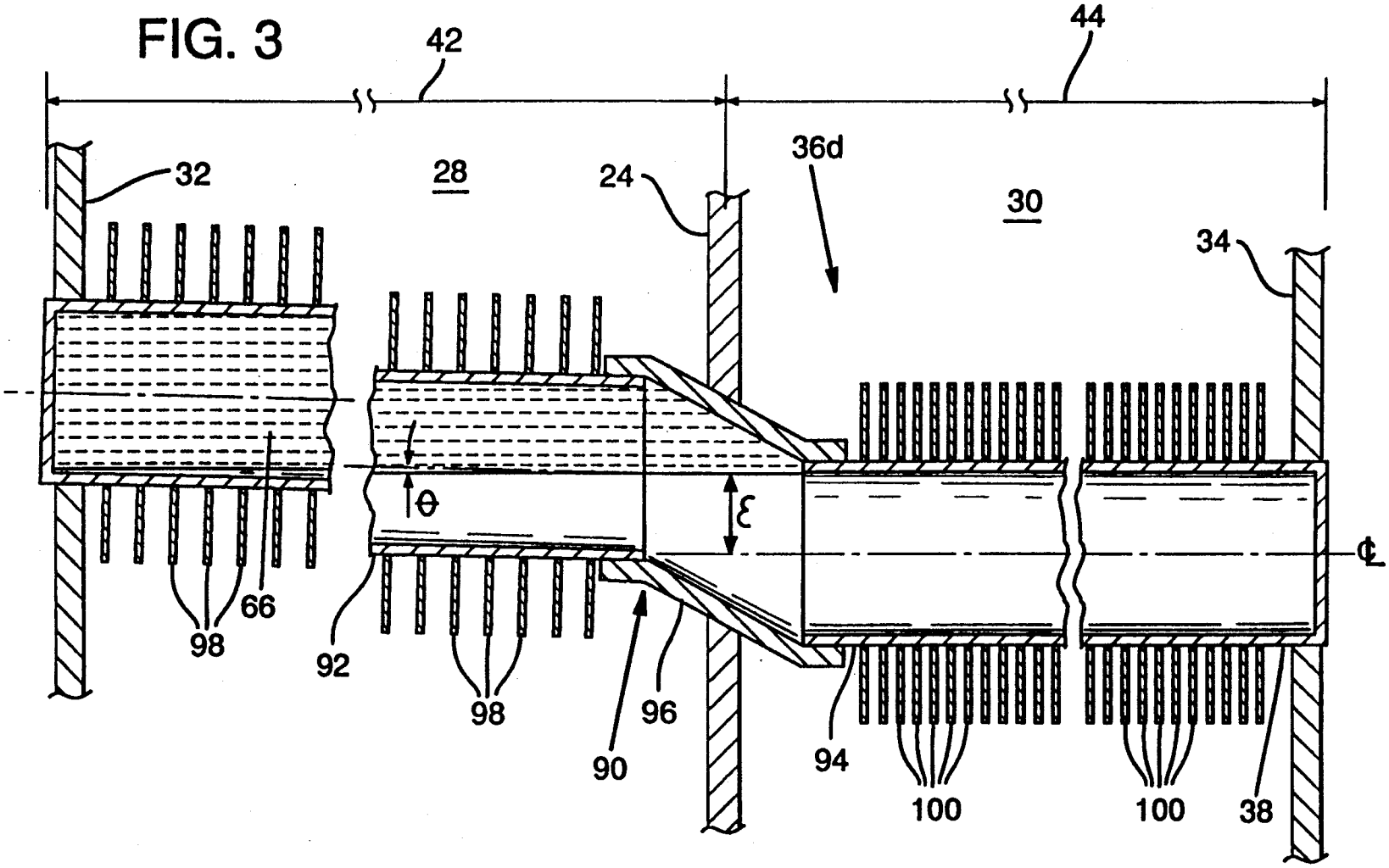
FIG. 3 is a fragmentary, foreshortened, enlarged view illustrating one manner of achieving a desired offset configuration of the evaporation sections of the Perkins tube components of the heat exchanger.

The degree of offset is indicated as epsilon of FIGS. 3, 4B and 6B. In practice, the magnitude of the offset may range from about ½th to about 15/16ths, preferably about ¾, of the inside tube diameter for the construction in which the evaporation and condensation section inside diameters are the same.

In the offset embodiment, the working fluid charge is such that during operation the evaporation sections are occupied by fluid to the extent of, broadly, from about 50% to about 97% of their volume while the condensation sections are substantially unoccupied by fluid.

More specifically, and by way of example, if the offset is ½ of its inside diameter, fluid is charged into the tube in amount such that about 50% of the evaporation section volume is occupied by working fluid during operation. Under this condition 50% of the inner evaporation section area is wetted by working fluid. If the offset is ¾ of the inside diameter of the tube, sufficient fluid is charged such that from about 75% to about 85% of the evaporation section volume is occupied by working fluid during operation. If the charge is 80.5%, 66.7% of the inner evaporation section area will be wetted by working fluid.

At an offset of ½ the inside diameter of the tube, the vapor flow area is 50% of the cross-sectional area of the tube. At an offset of ¾ of the inside diameter of the tube, the vapor flow area is 19.5% of the cross-sectional area of the tube, or a reduction by a factor of 2.56. The heat transport capacity is reduced by a like factor. If it is needed, this reduction in heat transport capacity can be compensated for by increasing the speed of rotation of the heat exchanger by a factor of 2.56.

Figure 6C:
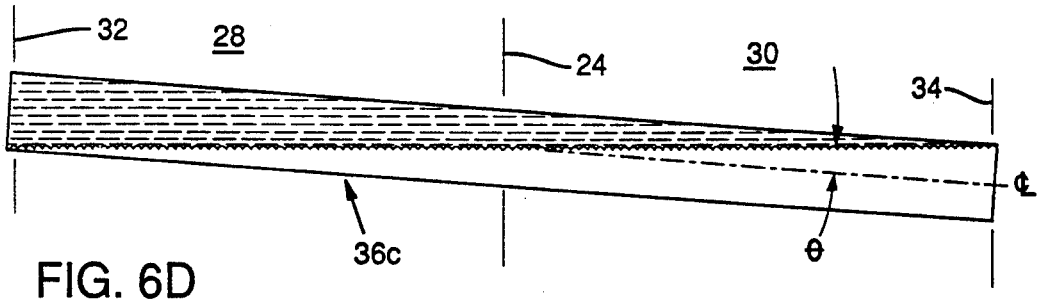

In the embodiment of FIGS. 4C and 6C, the outward radial displacement of the evaporation section of the Perkins tube is achieved by uniformly splaying the entire tube. By "splay" is meant the structural embodiment wherein the center line or axis of the evaporation section, and in this embodiment the condensation section as well, is not parallel to the axis of heat exchanger rotation but inclines therefrom by an angle theta. It inclines radially outwardly in the direction of evaporation chamber end plate 32.

The object of the splay is to minimize the amount of charge in the condensation section and to maximize the amount of charge in the evaporation section while simultaneously providing space for vapor flow. For the proper angle theta and a working fluid charge of 50% of the internal volume of the Perkins tube, FIG. 6C shows that at the location of end plate 34 (the outboard extremity), the tube is substantially empty and at the location of end plate 32 (the other outboard extremity), the tube is substantially filled. This is the optimum working fluid disposition. Preferably, the amount of working fluid charged is such that during operation the evaporation sections' volumes are occupied by fluid to the extent of from about 75% to about 85% and the condensation sections' volumes are occupied by fluid to the extent of from about 15% to about 25%.

The area provided for vapor flow progressively increases as does the quantity of vapor flow during operation from location of end plate 32 where it is zero to partition plate 24 where it is 50% of the inside tube area. This obtains when $L_e$ is equal to $L_c$, and if $L_e$ is greater than $L_c$ then the vapor flow area at partition plate 24 is greater than 50% and if $L_e$ is less than $L_c$, it is less than 50%.

The splay may be continuous throughout the entire length of the tube, or it may be present along the evaporation section thereof only. In the preferred embodiment of FIGS. 4C and 6C it starts at outboard condensation chamber end plate 34 and continues uniformly to outboard evaporation chamber end plate 32.

Although the angle of deviation (splaying) of the Perkins tube longitudinal axis relative to the axis of rotation of the heat exchanger is somewhat variable depending upon the various parameters of design and operation, the preferred angle of deviation (the angle theta) for a uniformly splayed Perkins tube and the aforementioned optimum fluid disposition is expressed by the relationship:

arc tangent of the ratio of the mean inside diameter of the Perkins tube divided by the length of the Perkins tube, both values being expressed in like terms of linear measurement.

For example, if the Perkins tube is 96 inches long ($L_e+L_c=96$ inches in FIG. 6A) and the mean inside diameter is 1 inch ($D_e=D_c=1$ inch in FIG. 6A), then the tangent of theta is equal to 1/96 and theta is 0.597 degree. If the Perkins tube is only 48 inches long instead of 96 inches, then the tangent of theta is 1/48 and theta is 1.19 degrees.

Thus the Perkins tube assembly 36C of FIGS. 4C and 6C comprises a continuous tube 82 having an evaporation section 84 in the evaporation chamber 28 and a condensation section 86 in the condensation chamber 30. The tube is provided with fins 85, 87 for the purpose above described. It is filled with Perkins tube working fluid 66.

To achieve the purposes of the invention, this fluid charge preferably is 50% of the internal volume of the Perkins tube, the consequence of which is that during operation of the heat exchanger the outer end of the evaporation section of the Perkins tube will be substantially filled with fluid while the outer end of the condensation section thereof will be substantially empty. The evaporation section will contain 78.5% of the working fluid and the condensation section will contain 21.5% of the working fluid in the case of a Perkins tube wherein $L_e=L_c$, $D_e=D_c$, and the initial charge is 50%.

In the embodiment of FIGS. 3, 4D, 5, and 6D (also illustrated in the general views of FIGS. 1 and 2) the desired outward radial displacement of the evaporation section of the Perkins tube relative to the condensation section is achieved by combining the benefits of offsetting and splaying. This is the preferred embodiment because during operation the condensation section is substantially free of working fluid and the area provided for vapor flow is in concert with the variability of the quantity of vapor flowing axially in the evaporation section, the consequence of which is that the wetted area within the evaporation section may be maximized.

In this embodiment the Perkins tube assembly **36*d* includes a sectioned Perkins tube indicated generally at 90. It is comprised of an evaporation section 92 and a condensation section 94, coupled together in communicating arrangement by means of a hollowed-angled connector 96. Radial heat exchange fins 98 are mounted on evaporation section 92. Similar fins 100 are mounted on condensation section 94**.

The evaporation section 92 contains working fluid 66 in an amount such that during operation of the heat exchanger it occupies all the volume within the evaporation section not coincidently required for vapor 101. The condensation section 94 remains substantially free of working fluid. The communication between the two sections via hollowed-angled connector 96 is preserved.

As section 5—5 exemplified by FIG. 5 is moved towards end plate 32, working fluid area 66 increases and vapor flow area 101 decreases. This is consistent with the concomitant decrease in volumetric vapor flow which obtains. As section 5—5 is moved toward partition plate 24, the preferred condition at partition plate 24 location is that the working fluid area 66 becomes equal to the vapor flow area 101 at which condition the offset epsilon is equal to ½ of the inside tube diameter $D_e$ of the evaporation section 92.

It will be observed that in this preferred embodiment that starting at partition plate 24, evaporation section 92 is splayed with reference to condensation section 94 at an angle theta having a value such that during operation, working fluid 66 substantially fills evaporation section 92 at the location of end plate 32 and occupies only 50% of evaporation section volume at the location of partition plate 24. Under this condition, the working fluid will occupy 78.5% (75% to 99% broadly stated) of the internal volumes of the evaporation sections, whereas the condensation section is virtually free of working fluid. The preferred angle theta when splay and offset are combined is expressed by the relationship:

arc tangent of the ratio of the difference between the mean inside diameter of the Perkins tube and the offset, all divided by the length of the evaporation section $L_e$.

For example, if the mean inside diameter of the Perkins tube is 1 inch and the offset is ½ inch and the length of the evaporation section is 48 inches, then the tangent of theta is equal to 0.5/48 and theta is 0.597 degree.

OPERATION

The operation of the rotary heat exchanger of my invention may best be explained with reference to the enlarged schematic views of FIGS. 6A–D inclusive.

The prior art heat exchangers of the class under consideration are fitted with an array of Perkins tubes **36*a* having the configuration shown in FIG. 6A. The tubes are continuous with their center lines parallel to the axis of rotation of the heat exchanger rotor. They contain a sufficient quantity of working fluid 66** to occupy the internal volume of the tubes to about half their capacity.

This turns out to be the optimum charge for FIG. 6A Perkins tube disposition. A larger charge causes more fluid to be present in the evaporation section, which improves heat transfer, and more fluid to be present in the condensation section, which deteriorates heat transfer. The converse is true for a lesser charge. It is easily shown that the maximum overall heat transfer occurs at exactly 50% charge.

During operation of the heat exchanger the working fluid 66 under the influence of centrifugal force assumes the disposition within the tube illustrated in FIG. 6A. Although this is an operative disposition, it is relatively inefficient for two reasons.

First, that portion of the working fluid 66 which is disposed in the evaporation section 60 of the Perkins tube covers and wets only about one-half the surface of the evaporation section. The remaining one-half of such surface accordingly is relatively idle and does not perform the heat exchange function of which it is capable.

Similarly, in the condensation section 62 of the Perkins tube about one-half of the inner surface of the condensation section is covered with fluid 66. Since the fluid acts as an insulator, the covered ½ area of the condensation section is relatively idle.

These disadvantages are overcome in large measure by the offset Perkins tube 36*b* of FIG. 6B wherein in the preferred embodiment epsilon is about ¾ of the inside tube diameter.

By offsetting radially outwardly the evaporation section 72 from the condensation section 74, and by predetermining the amount of working fluid 66 employed, the evaporation section will be maintained substantially occupied with working fluid conditioned upon providing the required space for vapor flow. The condensation section remains substantially empty, all the while maintaining vapor communication between the two sections for adequate heat transport. A similar situation exists in the splayed configuration of tube 36*c* of FIG. 6C, wherein the evaporation section 84 is displaced radially outwardly on the rotor by splaying. In this case the splay is initiated at the outboard end of the condensation chamber 30 and continues at a uniform angle theta to the outboard end of the evaporation chamber 28.

With 50% of the internal tube 82 volume occupied by working fluid 66, the situation illustrated in FIG. 6C obtains during rotation of the rotor: the evaporation section 84 of the Perkins tube is substantially occupied with working fluid while simultaneously providing optimum vapor flow space within the evaporation section and while in the condensation section 86 the quantity of working fluid is substantially reduced.

Figure 6D:
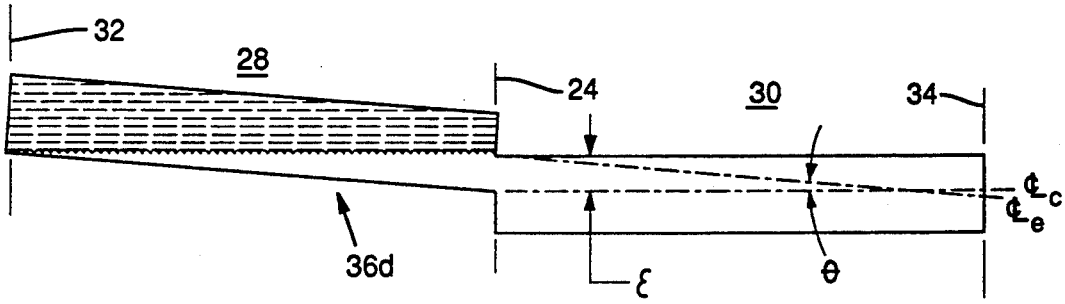

This desired result also is obtained in maximum degree in the preferred embodiment illustrated by tube 36*d* of FIG. 6D.

In this case the radial displacement of the evaporation section 92 of the Perkins tube relative to its condensation section 94 is obtained by a combination of offsetting and splaying. It will be noted that in contrast to the embodiment of FIG. 6C, splaying is initiated at partition plate 24, rather than outboard condensation chamber end plate 34. Nevertheless, the desired result is obtained: displacement, during operation of the heat exchanger, of working fluid 66 substantially entirely into the Perkins tube evaporation section. The heat transport capacity of case FIG. 6D is the same as that for FIGS. 6C and 6A.

In the above situations, and in the case where the internal heat transfer coefficients are infinite and the entire internal evaporator and condenser areas are effective, the theoretical beneficial effect is an improvement in the effectiveness of the example heat exchanger defined hereinafter to a value of 75%.

Against this target, the conventional heat exchanger of FIGS. 4A and 6A nets an effectiveness of 46.5%.

The offset heat exchanger of FIGS. 4B and 6B has an effectiveness of 58.5%.

The simple splayed heat exchanger of FIGS. 4C and 6C has an effectiveness of 54.5%.

The combined splayed and offset heat exchanger of FIGS. 4D and 6D, displays an effectiveness of 58.5%.

In a comparative study, the energy recovered by the prior art heat exchanger of FIGS. 4A and 6A was shown to be 412,560 Btu/hr. However, the improved splayed and offset heat exchanger of FIGS. 4D and 6D showed an energy recovery of 519,030 Btu/hr.

Converted to monetary values in comparable situations, a given prior art heat exchanger operating 2000 hours per year at a fuel cost of $10 per million BTU thus will save per year $8,251.00 in energy costs. A comparable improved heat exchanger of my invention will save $10,381.00.

Additionally, since the heat exchanger of my invention reduces exhaust gas temperature in the evaporation chamber to a lower level than does the conventional heat exchanger, it effectively condenses a wider variety of condensable contaminants from the exhaust gases which otherwise would not be condensed. They accordingly can be removed much more effectively.

In order to quantify improvements in heat exchanger effectiveness resulting from offsetting, splaying, and a combination thereof, the design of typical heat exchangers operating at typical gas temperatures and mass-flow rates, and embodying Perkins tubes of the designs, dispositions, and working fluid charges illustrated in FIGS. 4A and 6A, 4B and 6B, 4C and 6C, and 4D and 6D were evaluated using accepted principles. The pertinent parameters circumscribing the heat exchanger design and operating conditions are listed in notes 1 through 9 subtended to the following tabulation summarizing the results of the aforementioned evaluation:

SUMMARY OF PERFORMANCE DATA FOR VARIOUS PERKINS TUBE CONFIGURATIONS

| Example | Splay Angle, Theta | Offset, Epsilon | Number of Transfer Units | Effective-ness | Energy Recovered | Perkins Tube Through-put |
|---|---|---|---|---|---|---|
| — | degrees | inches | — | % | Btu/hr | kW/pipe |
| Prior Art, FIG. 6A | 0 | 0 | 0.87 | 46.5 | 412.560 | 1.55 |
| Offset, FIG. 6B | 0 | 0.78 | 1.41 | 58.5 | 519,030 | 1.95 |
| Splayed, FIG. 6C | 0.597 | 0 | 1.20 | 54.5 | 483,540 | 1.82 |
| Both, FIG. 6D | 0.597 | 0.50 | 1.41 | 58.5 | 519,030 | 1.95 |

1. Prior art Design shown on FIG. 1, U.S. Pat. No. 4,640,344 (Working Fluid, Freon-11), and basic improved design shown on FIG. 1 of this disclosure (working fluid is Freon-11).

2. Exhaust Gas Mass Flow Rate = Supply Gas Mass Flow Rate = 12,322.7 lbs/hr.

3. Exhaust Gas Temperature at Inlet Port 48 = 368° F.

4. Supply Gas Temperature at Inlet Port 52 = 68° F.

5. Perkins Tube (Wolverine Trufin Type H/A 61-0916058) Dimension 42 ($L_e$) = Dimension 44 ($L_c$) = 4 feet.

6. Inlet Port 48 Dimensions = Outlet Port 54 Dimensions = 4 feet axially by 1.117 feet radially.

7. Number of Perkins Tubes 36 per Row = 39 (2 rows)

8. Speed of Rotation = 340 rpm.

9. Perkins Tube Exhaust and Supply Gas-Side Heat Transfer Coefficients = 18 Btu/hr—ft—F.

The above values of energy recovered and effectiveness establish a significant increase in favor of the heat exchangers including Perkins tube having the improved configurations disclosed herein. The variation in the thermal performance among the four tabulated example heat exchangers is due exclusively to the variation in the disposition of the working fluid during operation as illustrated in FIGS. 6A, 6B, 6C, and 6D.

Having thus described in detail preferred embodiments of the present invention, it will be apparent to those skilled in the art that many physical changes may be made in the apparatus without altering the inventive concepts and principles embodied therein. The present embodiment is therefore to be considered in all respects as illustrative and not restrictive, the scope of the invention being indicated by the appended claims.

I claim:

1. A rotary heat exchanger for use in high gravity fields and comprising:

a) an outer case, b) a rotor mounted for rotation within the case, c) motor means connected to the rotor for rotating it at a predetermined speed, d) terminal and central partition means dividing the case interior longitudinally into an evaporation chamber and a condensation chamber, e) first inlet port means in the case for introducing into the evaporation chamber hot gas exhausted from an associated appliance, f) first outlet port means in the case for venting from the evaporation chamber exhaust gas in a cooled condition, g) second inlet port means in the case for introducing cool supply gas into the condensation chamber, h) second outlet port means in the case for venting from the condensation chamber supply gas in a heated condition, i) a plurality of Perkins tubes having communicating evaporation sections and condensation sections, j) mounting means mounting the Perkins tubes on the rotor with their evaporation sections extending into the evaporation chamber and their condensation sections extending into the condensation chamber, k) the evaporation sections being radially outwardly displaced from the condensation sections, l) and in the Perkins tubes a Perkins tube working fluid used in amount predetermined during operation of the heat exchanger (1) to charge a maximum proportion of the evaporation sections with fluid, (2) to leave a minimum space for fluid-derived vapor flow within the evaporation sections, and (3) to substantially eliminate the presence of fluid from the condensation sections, thereby increasing the efficiency of the evaporation cycle in the former and of the condensation cycle in the latter.

2. A rotary heat exchanger for use in high gravity fields and comprising:

a) an outer case, b) a rotor mounted for rotation within the case, c) motor means connected to the rotor for rotating it at a predetermined speed, d) terminal and central partition means dividing the case interior longitudinally into an evaporation chamber and a condensation chamber, e) first inlet port means in the case for introducing into the evaporation chamber hot gas exhausted from an associated appliance, f) first outlet port means in the case for venting from the evaporation chamber exhaust gas in a cooled condition, g) second inlet port means in the case for introducing cool supply gas into the condensation chamber, h) second outlet port means in the case for venting from the condensation chamber supply gas in a heated condition, i) a plurality of Perkins tubes having communicating evaporation sections and condensation sections, j) mounting means mounting the Perkins tubes on the rotor with their evaporation sections extending into the evaporation chamber and their condensation sections extending into the condensation chamber, k) the evaporation sections being radially outwardly displaced from the condensation sections, l) and in the Perkins tube a working fluid used in a predetermined amount such that during operation of the heat exchanger, (1) the fluid occupies more than 50% and less than 100% of the volume of the evaporation sections, (2) the fluid-derived vapor occupies more than 0% and less than 50% of the volume of the evaporation section and, (3) the fluid occupies less than 22% of the volume of the condensation section.

3. The rotary heat exchanger of claim 2 wherein the axes of the evaporation and condensation sections are substantially parallel to the axis of rotation of the rotor and the evaporation sections accordingly are radially outwardly offset from the condensation sections and wherein the working fluid charge is such that during operation the condensation sections are substantially unoccupied by fluid.

4. The rotary heat exchanger of claim 3 wherein the magnitude of offset is from about one-half to about 15/16ths of the inside diameter of the Perkins tube and wherein the working fluid charge is such that during operation the evaporation sections are occupied by fluid to the extent of from about 50% to about 97% whereas the condensation sections are substantially unoccupied by fluid.

5. The rotary heat exchanger of claim 3 wherein the magnitude of the offset is about three-fourths of the inside diameter of the Perkins tube and the fluid charge is such that during operation the evaporation sections' volumes are occupied by fluid to the extent of from about 75% to about 85% whereas the condensation sections' volumes are substantially unoccupied by fluid.

6. The rotary heat exchanger of claim 2 wherein the axes of the Perkins tubes are splayed radially in the outboard direction with reference to the axis of rotation of the rotor in such a manner as to displace the evaporation sections radially outwardly from the condensation sections and wherein the working fluid charge is such that during operation the evaporation sections' outboard extremities are substantially occupied by fluid and the condensation sections' outboard extremities are substantially unoccupied by fluid.

7. The heat exchanger of claim 6 wherein the axes of the Perkins tubes are splayed with reference to the axis of rotation of the rotor along substantially their entire length.

8. The rotary heat exchanger of claim 7 wherein the Perkins tubes are splayed with reference to the axis of rotation of the rotor at an angle substantially expressed by the relationship: arc tangent of the ratio of the mean inside diameter of the Perkins tube divided by the length of the Perkins tube.

9. The rotary heat exchanger of claim 7 wherein the working fluid charge is such that during operation the evaporation sections' volumes are occupied by fluid to the extent of from about 75% to about 85% and the condensation sections' volumes are occupied by fluid to the extent of from about 15% to about 25%.

10. The rotary heat exchanger of claim 2 wherein the axes of the Perkins tubes are splayed radially in the outboard direction with reference to the axis of rotation of the rotor in such a manner as to displace the evaporation sections radially outwardly from the condensation sections and wherein the initial working fluid charge is such that during operation the evaporation sections' outboard extremities are substantially completely occupied by fluid.

11. The heat exchanger of claim 10 wherein the axes of the evaporation sections only of the Perkins tubes are splayed.

12. The rotary heat exchanger of claim 11 wherein the Perkins tubes are splayed with reference to the axis of rotation of the rotor at an angle substantially expressed by the relationship: arc tangent of the ratio of the mean inside diameter of the Perkins tube divided by the length of the Perkins tube.

13. The rotary heat exchanger of claim 2 wherein the axes of the condensation sections are substantially parallel to the axis of rotation of the rotor and wherein the axes of the evaporation sections are simultaneously offset and splayed radially in the outboard direction and wherein the initial fluid charge is such that during operation, the evaporation sections' volumes are occupied by fluid to a maximum extent and the condensation sections' volumes are substantially unoccupied by fluid.

14. The rotary heat exchanger of claim 13 wherein the angle of splaying (theta) is determined substantially by the relationship: arc tangent of the ratio of the difference between the mean inside diameter of the Perkins tube and the offset dimension, all divided by the length of the evaporation section.

15. The rotary heat exchanger of claim 13 wherein the magnitude of the offset is from about one-half to about 15/16ths of the inside diameter of the Perkins tube and wherein the initial working fluid charge is such that during operation the evaporation sections' volumes are occupied by fluid to the extent of from about 75% to about 99% whereas the condensation sections' volumes are substantially unoccupied by fluid.

16. In a rotary heat exchanger including in its structure a rotor, an evaporation chamber and a condensation chamber, and mounted in the chambers, a plurality of Perkins tubes having evaporation sections and condensation sections, the improvement which comprises mounting the Perkins tubes with their evaporation sections displaced radially outwardly from their condensation sections, the tubes being charged with Perkins tube working fluid so as to occupy the evaporation sections substantially completely with working fluid while leaving therein a minimum space for fluid-derived vapor flow, and to substantially eliminate the presence of working fluid from the condensation sections.

17. The rotary heat exchanger of claim 16 wherein the outwardly displaced condition of the evaporation sections from the condensation sections is obtained by radially offsetting the former from the latter.

18. The rotary heat exchanger of claim 16 wherein the outwardly displaced condition of the evaporation sections from the condensation sections is obtained by splaying the Perkins tubes at an angle relative to the rotor substantially expressed by the relationship: arc tangent of the mean Perkins tube inside diameter divided by the Perkins tube length.

19. The rotary heat exchanger of claim 16 wherein the outwardly displaced condition of the evaporation sections relative to the condensation sections is obtained by offsetting the former relative to the latter and by splaying the evaporation sections at an angle relative to the rotor substantially expressed by the relationship: arc tangent of the ratio of the difference between the mean inside diameter of the Perkins tube and the offset dimension, all divided by the length of the evaporation section.

* * * * *